US010954895B2

(12) United States Patent
Fukui et al.

(10) Patent No.: US 10,954,895 B2
(45) Date of Patent: Mar. 23, 2021

(54) EVAPORATED FUEL TREATMENT DEVICE

(71) Applicant: AISAN KOGYO KABUSHIKI KAISHA, Obu (JP)

(72) Inventors: Keita Fukui, Fujinomiya (JP); Makoto Yamazaki, Gotemba (JP); Yoshikazu Miyabe, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/478,667

(22) PCT Filed: Dec. 20, 2017

(86) PCT No.: PCT/JP2017/045723
§ 371 (c)(1),
(2) Date: Jul. 17, 2019

(87) PCT Pub. No.: WO2018/139121
PCT Pub. Date: Aug. 2, 2018

(65) Prior Publication Data

US 2019/0376475 A1 Dec. 12, 2019

(30) Foreign Application Priority Data

Jan. 25, 2017 (JP) ..... JP2017-011039

(51) Int. Cl.
*F02M 25/08* (2006.01)

(52) U.S. Cl.
CPC .... *F02M 25/0854* (2013.01); *F02M 25/0836* (2013.01)

(58) Field of Classification Search
CPC ..... F02M 25/0854; F02M 25/0836; F02M 25/08; F02M 25/089; F02M 25/0872;
(Continued)

(56) References Cited

U.S. PATENT DOCUMENTS

2011/0220071 A1 9/2011 Horiba et al.
2015/0143996 A1 5/2015 Kimoto et al.
(Continued)

FOREIGN PATENT DOCUMENTS

JP 2011256778 A 12/2011
JP 2015102009 A 6/2015
(Continued)

*Primary Examiner* — George C Jin
(74) *Attorney, Agent, or Firm* — Hunton Andrews Kurth LLP

(57) ABSTRACT

The evaporated fuel treatment device includes: a canister that adsorbs evaporated fuel generated within a fuel tank that is provided to a vehicle; a vapor passage that connects the canister and the fuel tank; a shutoff valve capable of closing off and opening up the vapor passage. When a specific event by which a current position of the shutoff valve becomes unknown occurs and initialization processing has become necessary, a first process is performed in which the shutoff valve is operated by a first operating amount that is set as an operating amount capable of operating the shutoff valve to an operation limit, irrespective of the current position, while, when the initialization processing has become necessary without the specific event occurring, a second process is performed in which the shutoff valve is operated by a second operating amount that is an operating amount from the current position to an initial position, and that is smaller than the first operating amount.

1 Claim, 3 Drawing Sheets

(58) Field of Classification Search
CPC ..... F02D 41/2441; F02D 41/2464; F02D 41/004; F02D 41/2445
See application file for complete search history.

(56) References Cited

U.S. PATENT DOCUMENTS

| | | | | |
|---|---|---|---|---|
| 2015/0330338 | A1* | 11/2015 | Ito | F02M 25/089 123/520 |
| 2016/0146159 | A1 | 5/2016 | Kimoto et al. | |
| 2017/0284317 | A1* | 10/2017 | Kimoto | F02M 25/089 |
| 2017/0305266 | A1* | 10/2017 | Kimoto | B60K 15/03519 |

FOREIGN PATENT DOCUMENTS

| | | | |
|---|---|---|---|
| JP | 2015218659 | A | 12/2015 |
| WO | 2015/002063 | A1 | 1/2015 |

* cited by examiner

EVAPORATED FUEL TREATMENT DEVICE

CROSS-REFERENCE TO RELATED APPLICATIONS

This is a national phase application based on International Patent Application No. PCT/JP2017/045723 filed Dec. 20, 2017, claiming priority to Japanese Patent Application No. 2017-011039 filed Jan. 25, 2017, the entire contents of which all are incorporated herein by reference.

TECHNICAL FIELD

The present invention relates to an evaporated fuel treatment device that treats evaporated fuel generated within a fuel tank that is provided to a vehicle equipped with an internal combustion engine.

BACKGROUND ART

An evaporated fuel treatment device is per se known that is provided with a shutoff valve that employs a stepper motor for opening and closing a vapor passage that connects the fuel tank to a canister. Since, with this type of shutoff valve, there is a dead zone with respect to operation in the opening direction, accordingly learning processing is performed for storing a valve opening start position by operating the shutoff valve in its opening direction from a predetermined initial position. In order to perform learning processing, initialization processing is required for shifting the shutoff valve from its current position to its initial position, but the current position becomes unknown if the stepper motor loses its synchronization. Accordingly it is per se known (refer to Patent Document 1), if loss of synchronization of the stepper motor of the shutoff valve has been detected, to execute, as initialization processing, processing to shift the shutoff valve to its initial position by finding the initial position by operating the shutoff valve so that the shutoff valve reliably reaches its mechanical operation limit at which it becomes physically impossible for it to be operated further in the closing direction.

CITATION LIST

Patent Literature

Patent Document 1: Japanese Laid-Open Patent Publication 2015-218659.

SUMMARY OF INVENTION

Technical Problem

Since, in the case of initialization processing as in Patent Document 1, the shutoff valve is operated irrespective of its position, so that drive force operates in the closing direction even though the shutoff valve has reached its operation limit in its closing direction, accordingly mechanical loading is repeatedly applied to the shutoff valve by implementing the initialization processing without limit, and the durability of the shutoff valve may become deteriorated.

Therefore, an object of the present invention is to provide an evaporated fuel treatment device, with which it is possible to suppress deterioration of the durability of the shutoff valve due to initialization processing.

Solution to Problem

The evaporated fuel treatment device of the present invention includes: a canister that adsorbs evaporated fuel generated within a fuel tank that is provided to a vehicle including an internal combustion engine; a vapor passage that connects the canister and the fuel tank; a shutoff valve provided in the vapor passage and capable of closing off and opening up the vapor passage; and a control device that executes initialization processing to shift the shutoff valve from a current position to an initial position that is set based on an operation limit in a closing direction, wherein, when a specific event by which the current position of the shutoff valve becomes unknown occurs and the initialization processing has become necessary, the control device performs a first process, as the initialization processing, in which the shutoff valve is operated by a first operating amount that is set as an operating amount capable of operating the shutoff valve to the operation limit, irrespective of the current position, and wherein, when the initialization processing has become necessary without the specific event occurring, the control device performs a second process, as the initialization processing, in which the shutoff valve is operated by a second operating amount that is an operating amount from the current position to the initial position, and that is smaller than the first operating amount.

Advantageous Effects of Invention

According to the evaporated fuel treatment device of the present invention, the details of the initialization processing for the shutoff valve are changed over according to whether or not the specific event has occurred in which the current position of the shutoff valve becomes unknown. The first process, which is performed if the specific event has happened, is a process of operating the shutoff valve so that it arrives at its operation limit, while on the other hand the second process, which is performed if the specific event has not happened, is a process of operating the shutoff valve from its current position to its initial position. Due to this, as compared with the case in which, as the initialization processing, a process is performed of simply operating the shutoff valve to its operation limit irrespective of whether or not the specific event has occurred, it is possible to reduce the frequency of drive force acting upon the shutoff valve in its closing direction due to this initialization processing even though the shutoff valve has reached its operation limit. And, due to this, it is possible to suppress deterioration of the durability of the shutoff value due to this initialization processing.

DESCRIPTION OF EMBODIMENTS

Figure 1:
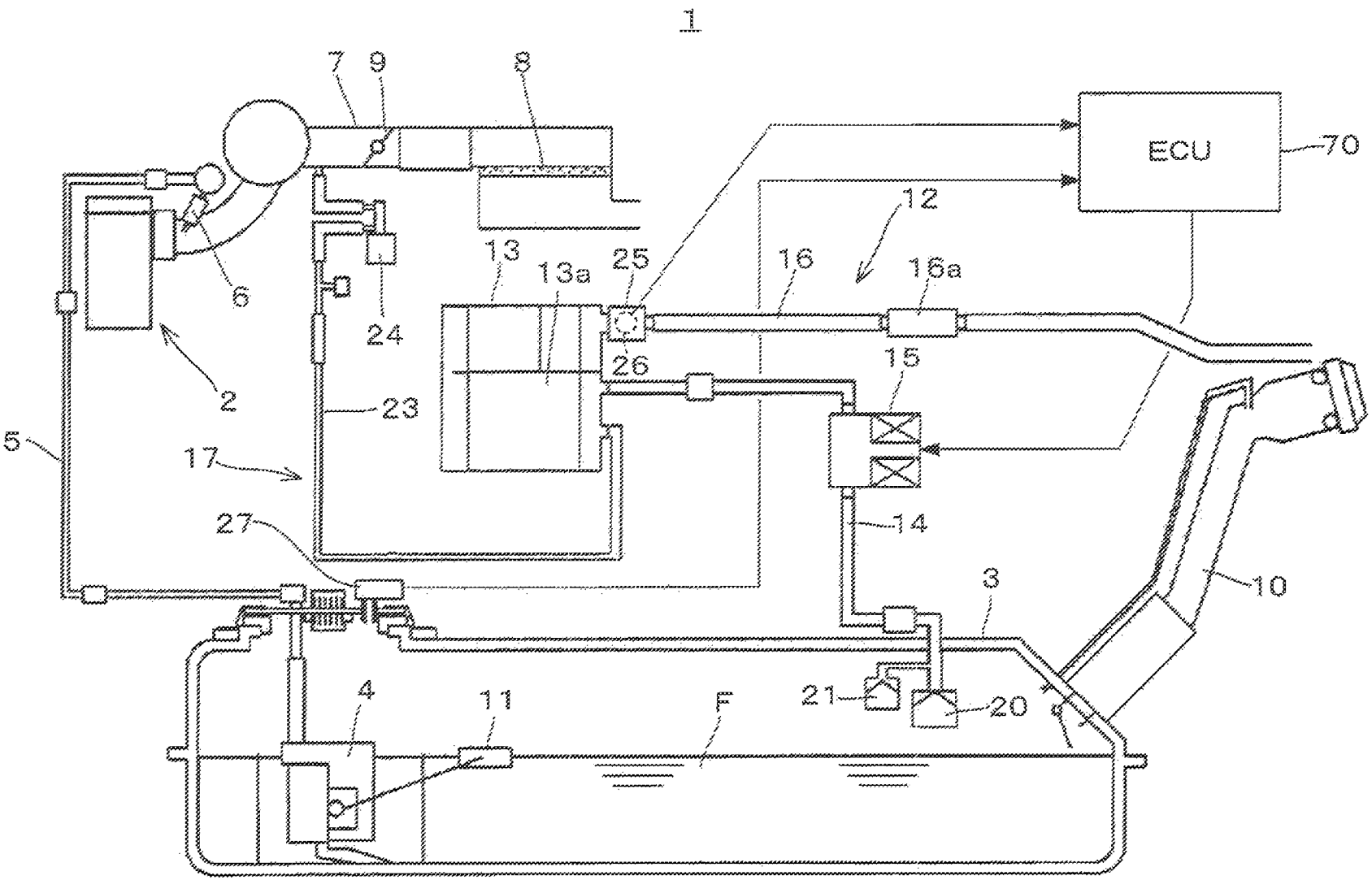
FIG. 1 is a schematic structural diagram showing a part of a vehicle including an evaporated fuel treatment device according to an embodiment of the present invention.

As shown in FIG. 1, a vehicle 1 includes an internal combustion engine 2 built as a gasoline engine that is provided as a source of drive power for propulsion, and a fuel tank 3 that stores gasoline, which is the fuel for the internal combustion engine 2. The fuel F stored in the fuel tank 3 is sucked up by a fuel pump 4 and is supplied to an intake passage 7 of the internal combustion engine 2 via a feed pipe 5 and a fuel injection valve 6. An air filter 8 is provided for filtering the air in the intake passage 7, and a throttle valve 9 is provided for adjusting the amount of intake air. An inlet pipe 10 is provided for supplying fuel into the fuel tank 3. The amount of fuel F remaining is detected by a float type remaining amount sensor 11.

An evaporated fuel treatment device 12 is provided to the vehicle 1 for treating the evaporated fuel generated in the fuel tank 3. The evaporated fuel treatment device 12 includes a canister 13 that internally contains an adsorbent 13*a* for adsorbing evaporated fuel, a vapor passage 14 that connects the canister 13 and the fuel tank 3, a shutoff valve 15 that is provided in the vapor passage 14 and that is capable of closing off and opening up the vapor passage 14, an atmosphere communication pipe 16 provided to the canister 13 that vents it to the atmosphere, and a purge device 17 that supplies, to the intake passage 7 of the internal combustion engine 2, purge gas purged from the canister 13 by external air inducted into the canister 13 via the atmosphere communication pipe 16.

An ORVR valve 20 and a COV valve 21 are provided to a connection portion between the vapor passage 14 and the fuel tank 3. The ORVR valve 20 and the COV valve 21 are constituted to intercept communication between the vapor passage 14 and the fuel tank 3 when the liquid surface of the fuel F within the fuel tank 3 reaches the height thereof. And the purge device 17 includes a purge passage 23 connected between the canister 13 and the intake passage 7 of the internal combustion engine 2 for conducting purge gas to the internal combustion engine 2, and a purge control valve 24 provided in the purge passage 23. The purge control valve 24 is built as a vacuum switching valve (VSV) that operates due to negative pressure in the intake passage 7. When the purge control valve 24 is open, external air is conducted into the canister 13 via the atmosphere communication pipe 16, and the purge gas described above is supplied to the intake passage 7 of the internal combustion engine. It should be understood that the external air that is conducted into the canister 13 is filtered by an air filter 16*a* provided in the atmosphere communication pipe 16.

A key-off pump 25 is provided in a connection portion between the atmosphere communication pipe 16 and the canister 13. The key-off pump 25 is provided in order to perform testing for detection of an anomaly, such as the opening of a hole or the like in the test subject, i.e. the canister 13 and the fuel tank 3 and so on. Apart from a pump that is driven during this testing, the key-off pump 25 also includes a pressure sensor 26 that measures the pressure within the canister 13.

Figure 2:
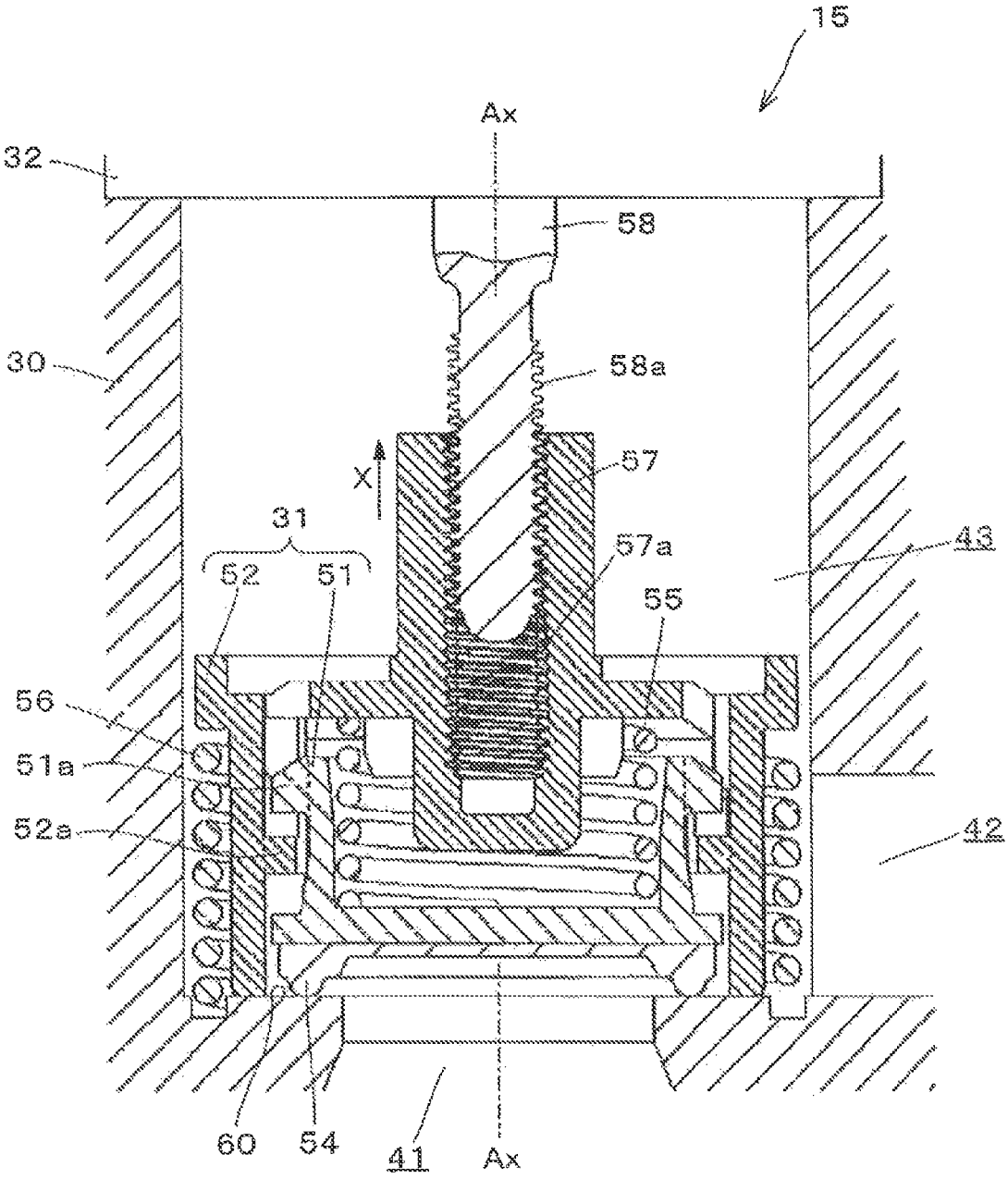
FIG. 2 is a sectional view showing the construction of a shutoff valve.

The shutoff valve 15 is shown in detail in FIG. 2, and is built as a flow rate control valve that closes the vapor passage 14 in its closed state, and leaves the vapor passage 14 opened in its opened state and moreover is capable of controlling the flow rate of evaporated fuel by changing its opening amount. As shown in FIG. 2, the shutoff valve 15 includes a casing 30, a valve body 31 received in the casing 30, and a stepper motor 32 that drives the valve body 31.

The casing 30 is formed with a flow inlet path 41 into which evaporated fuel flows, a flow outlet path 42 out through which evaporated fuel flows, and a valve chamber 43 that is respectively connected to the flow inlet path 41 and the flow outlet path 42 and houses the valve body 31. The valve body 31 includes an inner valve portion 51 that is capable of closing the flow inlet path 41, and a guide portion 52 that is disposed so as to surround the inner valve portion 51, and whose upper end in FIG. 2 is closed while its lower end is open. The inner valve portion 51 and the guide portion 52 are concentrically combined with each other about an axial line Ax as a center, in a state of being capable of shifting relative to one another in the direction of the axial line Ax. A seal member 54 that is made, for example, from synthetic rubber is provided at the lower end of the inner valve portion 51, and this seal member 54 is capable of closing the flow inlet path 41 by pressing tightly against a valve seat 60 of the casing 30 that is provided at an opening position of the flow inlet path 41.

A coil spring 55 that biases the inner valve portion 51 toward the valve seat 60 is provided in a compressed state between the inner valve portion 51 and the guide portion 52. The guide portion 52 is provided in the casing 30 in a state in which it is shiftable along the direction of the axial line Ax and moreover in a state in which it is not capable of rotating around the axial line Ax. Furthermore, a coil spring 56 is provided in a compressed state between the guide portion 52 and the casing 30. The guide portion 52 is biased in the direction away from the valve seat 60 by the elastic force of the coil spring 56. A female screw portion 57 is provided at the upper portion of the guide portion 52. A female screw thread 57*a* that is formed upon the female screw portion 57 is meshed with a male screw thread 58*a* that is formed on an output shaft 58 of the stepper motor 32. Due to this structure, the guide portion 52 of the valve body 31 is shifted in the opening direction as shown by the arrow sign X, or in the direction opposite thereto, according to the amount of operation of the stepper motor 32.

The state of FIG. 2 is a state in which the lower end of the guide portion 52 of the valve body 31 is positioned at its operational limit in the closing direction, in which it contacts the valve seat 60 so that the vapor passage 14 is in the closed state. In the embodiment, the state of FIG. 2 is defined as being one example of the initial position.

In the initial position of the present embodiment shown in FIG. 2, the seal member 54 of the inner valve portion 51 is pressed against the valve seat 60 by the elastic force of the coil spring 55, and the shutoff valve 15 is in its closed state. And, when the stepper motor 32 is driven so that the guide portion 52 shifts in the opening direction from its initial position, the lower end of the guide portion 52 starts to be moved away from the valve seat 60. Furthermore, when the valve operating amount in the opening direction further increases, a projecting portion 52*a* that is provided on the guide portion 52 so as to project in the inward direction and a projecting portion 51*a* that is provided on the inner valve portion 51 so as to project in the outward direction come into contact with one another. Until these projecting portions 52*a* and 51*a* come into mutual contact, the seal member 54 of the inner valve portion 51 is kept in its closed state in which it is pressed against the valve seat 60. But when, in the state in which these projecting portions 52*a* and 51*a* are in mutual contact, the guide portion 52 is further operated in the opening direction, the guide portion 52 and the inner valve portion 51 both shift together in the opening direction, and the seal member 54 of the inner valve portion 51 is moved away from the valve seat 60. Since, due to this, the flow inlet path 41 is opened, accordingly the flow inlet path 41 and the flow outlet path 42 are mutually communicated together via the valve chamber 43, so that opening of the vapor passage 14 is permitted.

In this manner, during operation from its initial position, the shutoff valve 15 is kept in the closed state until the projecting portion 52*a* of the guide portion 52 and the projecting portion 51*a* of the inner valve portion 51 come into mutual contact, at which time point the shutoff valve 15 is operated in the opening direction. And the position at which, in the state in which these projecting portions 52*a* and 51*a* are in mutual contact, the guide portion 52 is operated in the opening direction and the seal member 54 of the inner valve portion 51 is moved away from the valve seat 60, is an example of a valve opening start position. Variation of this valve opening start position occur due to tolerances between the guide portion 52 of the shutoff valve 15 and the inner valve portion 51 and so on, and due to a secular change thereof. Accordingly, a learning process is implemented in order to detect and to store the valve opening start position that is currently intrinsic to the shutoff valve 15. In order for the initial position to be a reference for this learning process, as one example, as a preliminary to performing the learning process, the engine control unit (ECU) 70 of FIG. 1 performs initialization processing for returning the shutoff valve 51 from its current position to its initial position. The ECU 70 is built as a computer that controls the operational state of the internal combustion engine 2.

Normally, since the current position of the shutoff valve 15 is recognized by the ECU 70, therefore, when executing initialization processing, the amount of operation of the shutoff valve 15 from the current position to the initial position is known. Accordingly, the shutoff valve 15 can be shifted to its initial position with no particular inconvenience by operating the shutoff valve 15 in the closing direction by that amount of operation. However, if some specific event occurs to make the current position of the shutoff valve 15 become unknown, then it is not possible to execute initialization processing correctly, since the amount of operation of the shutoff valve 15 from its current position to its initial position is not clear. Accordingly, as one example, the ECU 70 varies the details of initialization processing between when the specific event occurs, and when it does not occur.

Examples of such a specific event may be: when the shutoff valve 15 is disconnected; when the shutoff valve 15 has been forcibly driven from another element; when the ECU 70 is exchanged; when the voltage of the auxiliary equipment battery mounted to the vehicle 1 drops below a limit value; and the like.

Figure 3:
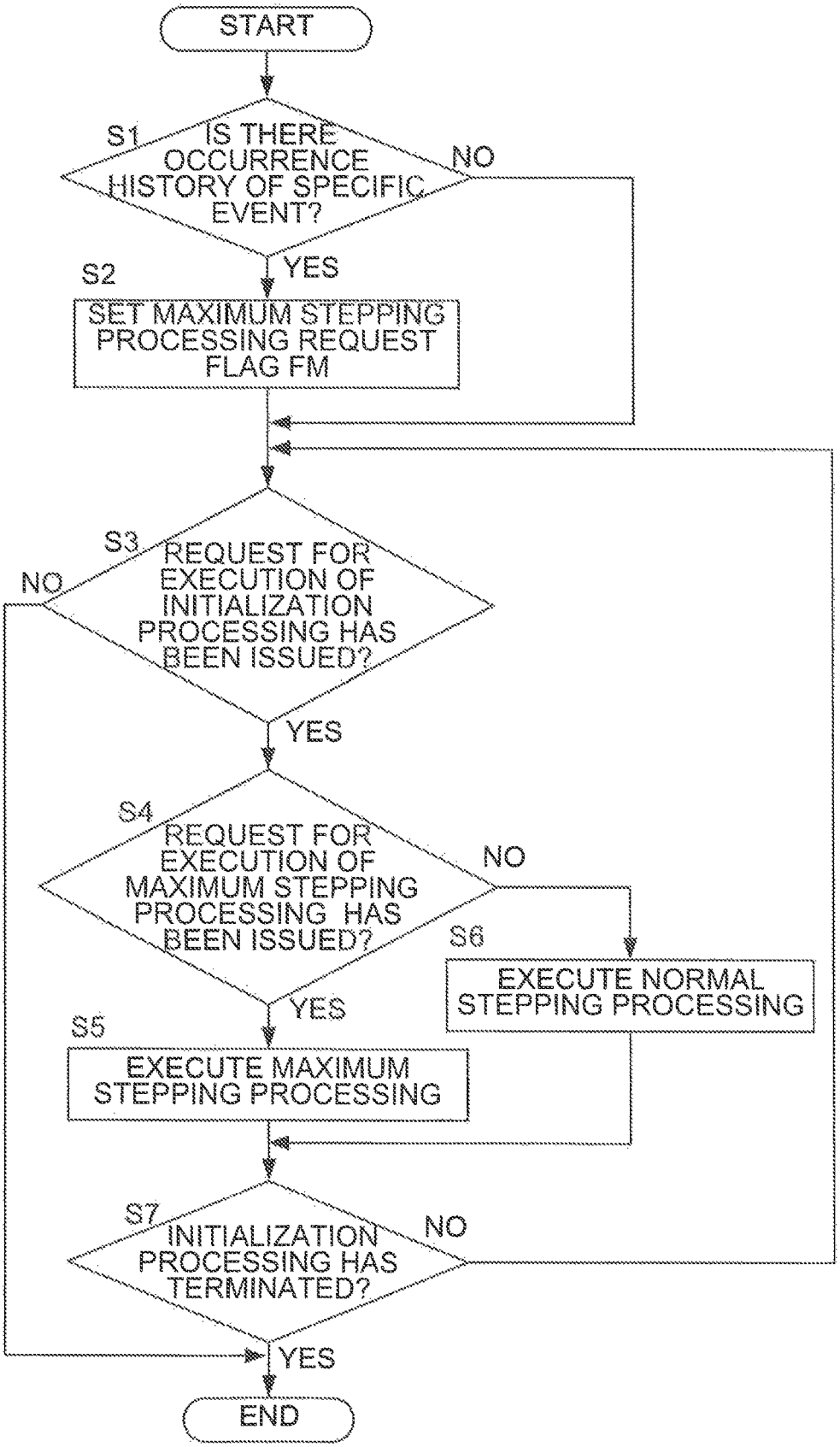
FIG. 3 is a flow chart showing an example of a control routine related to an embodiment of the present invention.

FIG. 3 shows an example of a control routine that is executed by the ECU 70. A program for the control routine of FIG. 3 is read out by the ECU 70 as required, and is repeatedly executed at predetermined intervals. By executing the control routine of FIG. 3, the ECU 70 functions as an example of the control means according to the present invention.

In step S1 of FIG. 3, the ECU 70 decides whether or not there is an occurrence history of the specific event described above having occurred. If there is such an occurrence history of the specific event, then the flow of control proceeds to step S2, but if not then the step S2 is skipped and the flow of control proceeds to step S3.

In step S2, the ECU 70 sets a maximum stepping processing request flag Fm in order to manage whether or not maximum stepping processing corresponding to an example of a first process according to the present invention is required. The flag Fm is, for example, a variable that is allocated in a predetermined storage region of the ECU 70, and is substituted with 1 if it is set and with 0 if it is cleared. Accordingly, it is possible to distinguish whether or not maximum stepping processing is required by referring to this flag Fm.

In step S3, the ECU 70 decides whether or not a request for execution of initialization processing has been issued. A request for execution of initialization processing is, for example, issued when the learning processing described above is to be executed, and before the processing is executed. The process of issuing a request for execution of initialization processing is performed by a control routine not shown in the figures that is executed in parallel with the control routine of FIG. 3. If a request has been issued for initialization processing to be performed, then the flow of control proceeds to step S4, whereas if there is no such request, then the subsequent processing is skipped and this cycle of the routine terminates, since there is no need for initialization processing.

In step S4, the ECU 70 refers to the maximum stepping processing execution request flag Fm, and decides whether or not there has been a request for execution of maximum stepping processing. If there has been a request for execution of maximum stepping processing, then the flow of control proceeds to step S5 and maximum stepping processing is executed. On the other hand, if there has not been a request for execution of maximum stepping processing, then the flow of control proceeds to step S6 and normal stepping processing, which is an example of the second process of the present invention, is executed.

In the maximum stepping processing, the shutoff valve 15 is operated in the closing direction by a first operating amount, which is set as being an operating amount with which the shutoff valve can arrive at its operating limit in the closing direction, irrespective of its current position. In the present embodiment, as one example, the first operating amount may be set to an operating amount that is a combination of a mechanical operation limit amount from the limit position of the shutoff valve 15 in its opening direction to its limit position in its closing direction, together with a basic operating amount from a home position of the shutoff valve 15 that is set in advance to its initial position. In this embodiment, the operation limit amount may, for example, be 240 steps, while the basic operating amount may be, for example, 8 steps. Accordingly, the first operating amount is 248 steps. If the basic operating amount is 8 steps, and if the initial position is taken as being the 0-th step, then the home position becomes the position of the 8-th step. When the ECU 70 executes the first process, irrespective of the current position of the shutoff valve 15, the shutoff valve 15 arrives at its operation limit in its closing direction, due to the shutoff valve 15 being operated in its closing direction by the first operating amount.

As is clear from FIG. 2, when the shutoff valve 15 is operated in its closing direction and the lower end of the guide portion 52 comes into contact with the valve seat 60, the stepper motor 32 loses its synchronization because the shutoff valve cannot shift further in the closing direction. For example, the ECU 70 detects this loss of synchronization, stores this detected position as an initial position, stops the shutoff valve 15 at this initial position, and terminates the first process. On the other hand, in the normal stepping processing that is executed in step S6, the shutoff valve 15 is operated in its closing direction by a second operating amount, which is the operating amount from its home position, i.e. its current position, to its initial position, and the shutoff valve 15 is stopped at its initial position. In the case of the second process it should be understood that, since the shutoff valve is operated by the second operating amount, accordingly no drive force acts in the closing direction, even if the shutoff valve 15 reaches its operation limit.

In step S7, the ECU 70 decides whether or not any processing of the maximum stepping processing or the normal stepping processing that have been executed as initialization processing has terminated. If the initialization processing has been completed, then this cycle of the routine terminates, whereas if the initialization processing is not completed, then the flow of control returns to step S3 and execution of this routine is repeated.

According to the present embodiment, on the one hand the maximum stepping processing that is performed if the specific event described above has occurred is processing to operate the shutoff valve 15 so that it arrives at its operation limit, while on the other hand the normal stepping processing that is performed if the specific event described above has not occurred is processing to operate the shutoff valve 15 from its home position, which is its current position, to its initial position. Due to this, as for example compared to the case in which, irrespective of whether or not the specific event has occurred, only processing to operate the shutoff valve 15 to its operation limit, for example maximum stepping processing, is executed as initialization processing, it is possible to reduce the frequency at which, even though the shutoff valve 15 reaches its operation limit due to this initialization processing, still its drive force operates in the closing direction, in other words to reduce the frequency at which, even though the lower end of the guide portion 52 has struck against the valve seat 60, the lower end of the guide portion 52 still presses hard against the valve seat 60. Due to this, it is possible to prevent deterioration of the durability of the shutoff valve 15 accompanying the initialization processing.

The present invention is not limited to the embodiment described above; it could be implemented in various ways, within the scope of the range of the present invention. Moreover, while in the embodiment described above the current position is taken as being the home position that is set in advance, it would also be possible to implement an embodiment in which the current position is always grasped without particularly determining it.

The shutoff valve 15 of the embodiment described above is only an example; any type of shutoff valve would be acceptable, provided that it is a shutoff valve that is built so that its closed state in which it closes the vapor passage is maintained from its initial position in which it closes the vapor passage until its operating amount in the opening direction exceeds a valve-open range, and that it is capable of being the subject of learning processing for its valve opening start position and of initialization processing that is performed upon the assumption of this learning processing. For example, as one example of a shutoff valve according to the present invention, it would be possible to employ a ball valve having a spherical valve body formed with a through flow conduit and a valve seat that rotatably holds this valve body and communicates with the vapor passage, so that the opening amount can be adjusted by rotating the valve body with an electric motor. Moreover, although the vehicle 1 of the embodiment described above was a vehicle provided with an internal combustion engine 2 as a source of power for traveling, it would also be possible for it to be changed to being a hybrid vehicle that, in addition to an internal combustion engine 2, is also provided with an electric motor as a source of power for traveling. Furthermore, while the internal combustion engine 2 described above was a gasoline engine, the internal combustion engine that is the subject of the present invention may also be a diesel engine, or a bi-fuel engine that is capable of using a fuel consisting of a mixture of gasoline and alcohol.

In the embodiment described above, the operation limit shown in FIG. 2 was set as one example of the initial position, but as another example, as the initial position, it would also be possible to set a position that is within the valve-closed range of the shutoff valve 15 in which it closes the vapor passage 14, and that moreover is separated by a predetermined amount in the closing direction from the operation limit state shown in FIG. 2. In this case, the present invention may be considered as being the following evaporated fuel treatment device. That is, the evaporated fuel treatment device includes: a canister that adsorbs evaporated fuel generated within a fuel tank that is provided to a vehicle including an internal combustion engine; a vapor passage that connects the canister and the fuel tank; a shutoff valve provided in the vapor passage and capable of closing off and opening up the vapor passage; and a control device that executes initialization processing to shift the shutoff valve from a current position to an initial position that is set based on an operation limit in a closing direction, and wherein, when a specific event by which the current position of the shutoff valve becomes unknown occurs and the initialization processing has become necessary, the control device performs a first process, as the initialization processing, in which the shutoff valve is operated by a first operating amount that is set as an operating amount capable of operating the shutoff valve to the operation limit, irrespective of the current position, and wherein, when the initialization processing has become necessary without the specific event occurring, the control device performs a second process, as the initialization processing, in which the shutoff valve is operated by a second operating amount that is an operating amount from the current position to the initial position, and that is smaller than the first operating amount, and wherein, the initialization position is set to a position that is within a valve-closed range of the shutoff valve, and is away from the operation limit by a predetermined amount in the closing direction.

Since, according to this evaporated fuel treatment device, the initial position is set to a position that is away from the operation limit by the predetermined amount in the opening direction, therefore it is possible reliably to avoid reaching the operation limit due to execution of the second process. Due to this, it is possible further to avoid deterioration of the durability of the shutoff valve.

REFERENCE SIGNS LIST

1: vehicle
2: internal combustion engine
3: fuel tank
12: evaporated fuel treatment device
13: canister
14: vapor passage
15: shutoff valve
70: ECU (control device)

The invention claimed is:

1. An evaporated fuel treatment device, comprising:

a canister that adsorbs evaporated fuel generated within a fuel tank that is provided to a vehicle including an internal combustion engine;

a vapor passage that connects the canister and the fuel tank;

a shutoff valve provided in the vapor passage, including a motor, and capable of closing off and opening up the vapor passage; and a control device that executes initialization processing to shift the shutoff valve from a current position to an initial position that is set based on an operation limit in a closing direction, wherein, when a specific event by which the current position of the shutoff valve becomes unknown occurs and the initialization processing has become necessary, the control device performs a first process, as the initialization processing, in which the shutoff valve is operated by a first operating amount that is set as an operating amount capable of operating the shutoff valve to the operation limit, irrespective of the current position, wherein, when the initialization processing has become necessary without the specific event occurring, the control device performs a second process, as the initialization processing, in which the shutoff valve is operated by a second operating amount that is an operating amount from the current position to the initial position, and that is smaller than the first operating amount, and wherein the control device detects loss of synchronization of the motor that occurs while performing the first process, stores a position when detecting the loss of synchronization as the initial position, and stops the shutoff valve at the initial position to terminate the first process.

* * * * *